US006513699B2

(12) United States Patent
Harten et al.

(10) Patent No.: US 6,513,699 B2
(45) Date of Patent: Feb. 4, 2003

(54) PROCESS FOR THE PRODUCTION OF METAL PIPES

(75) Inventors: Friedrich Harten, Hannover (DE); Michael Meyer, Fuhrberg (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/771,635

(22) Filed: Jan. 30, 2001

(65) Prior Publication Data

US 2001/0042773 A1 Nov. 22, 2001

(30) Foreign Application Priority Data

Feb. 1, 2000 (EP) ..... 00400311

(51) Int. Cl.[7] ..... B21D 39/02
(52) U.S. Cl. ..... 228/158; 228/173.6; 492/3
(58) Field of Search ..... 228/158, 173.6–173.5, 228/173.4, 173.1, 173.2; 492/3; 427/402, 249.1, 249.7, 249.4; 226/112; 72/176, 442, 208, 251

(56) References Cited

U.S. PATENT DOCUMENTS

| | | | |
|---|---|---|---|
| 3,260,099 A | | 7/1966 | Elge |
| 3,349,832 A | * | 10/1967 | Crowdes et al. |
| 3,368,379 A | * | 2/1968 | Wakefield |
| 3,974,555 A | | 8/1976 | Strohmeier et al. |

OTHER PUBLICATIONS

Database Inspec 'Online!—Institute of Electrical Engineers, h. j. Scheibe et al, Laser–arc technology for industrial hard coating deposition Database accession No. 5916770 XP002144621—Fifth International Conference on Plasmas Surface Engineering—Germany, Sep. 9–13, 1996.

Patent Abstracts of Japan, vol. 017, No. 534 (M–1486), Sep. 27, 1993 corresponding to JP 05 164820 A (Kyocera Corp) dated Jun. 15, 1993.

Database Inspeec 'Online! Institute of Electrical Engineers, Stevenage, GB; J. F. Braza et al, "Tribological behaviour of diamond and diamondlike carbon films: status and prospects" Database accession No. 4256745—XP00214462—Fifth International Conference on Surface Modification Technologies, Sep. 2–4, 1991.

* cited by examiner

*Primary Examiner*—Tom Dunn
*Assistant Examiner*—Jonathan Johnson
(74) *Attorney, Agent, or Firm*—Sughrue Mion, PLLC

(57) ABSTRACT

A process for the production of metal pipes is described in which a thin-walled metal band inclined toward cold spots is gradually formed into a slotted pipe, the longitudinal edges lying flush against one another are welded to one another, and the welded pipe is reduced in its diameter. The forming of the metal band into the slotted pipe is done by opposing metal forming rollers or forming cylinders cooperating pairwise. The forming rollers or forming cylinders guide the metal band to be deformed in its edge area with rolling friction between them. Therein the forming and guiding of the metal band is done with forming rollers and/or forming cylinders and the reduction with rollers whose surface hardness is greater than 100 GPa.

2 Claims, 2 Drawing Sheets

PROCESS FOR THE PRODUCTION OF METAL PIPES

BACKGROUND OF THE INVENTION

The invention relates to a process and apparatus for the production of metal pipes according to the preamble of claim 1 and claim 3.

1. Field of the Invention

To achieve a faultless weld seam it is of decisive importance that, on the one hand, the edges of the band to be welded are free of oil and oxide and, on the other hand, the edges of the band are guided clean and during the welding process lie exactly flush and at the same height relative to each other. For this purpose the band edges of the de-oiled metal band are trimmed immediately before the forming of the slotted pipe. Moreover, attention must be given to the deformation of the metal band into the slotted pipe.

2.Discussion of the Related Art

For metal bands of steel and copper, forming tools of steel have proven themselves which consist of pairs of forming rollers or forming cylinders. Therewith the metal band is gradually deformed between the forming rollers or forming cylinders into a slotted pipe.

For bands of metals which incline toward cold spots such as, for example aluminum, aluminum alloys, stainless steel, niobium, titanium, i.e., forming tools of plastic are used. However, their disadvantage lies in a low tool life. The use of forming tools of steel has the disadvantage that cold spots arise at the forming rollers or forming cylinders which build up more and more and change the geometry of the forming tool, which ultimately leads to an incomplete forming of the pipe and thus to a poor weld seam. These cold spots appear more at those points at which a strong deformation of the metal band is done. In the "Uniwema" process described, this is the first forming stage in which a radius of curvature is imparted to the areas of the edges of the bands which is present in the finished slotted pipe.

For the solution of this problem it is known from DE-U-94 03 594 that on the surface of the lower forming roller or forming cylinder turned away from the metal band, at least in the first forming stage where the deformation is greatest, a brush device engages which keeps the surface of the forming roller or forming cylinder blank.

The disadvantage of this known apparatus is to be seen in the fact that the surface of the forming rollers or forming cylinders is stressed additionally by the engagement of the brush device and not only the cold spot particles are removed. Thereby additional wear of the forming rollers or forming cylinders occurs.

Also the,brushes themselves wear and have to be exchanged, which leads to an interruption of production. Moreover, the amount of contaminants is very high, whereby the welding process is also disturbed. A quite decisive disadvantage is that an aluminum dust explosion can result with the use of aluminum bands.

If the welded pipe has to be reduced in its diameter, the same problem of cold spots also occurs in this tool since pains are taken to perform the reduction in one operational step.

BRIEF SUMMARY OF THE INVENTION

This objective is realized by the features covered in claims 1 and 3.

The essential advantage of the invention is to be seen in the fact that due to the extremely high hardness of the surface of the forming cylinders or forming rollers the amount of friction between the band and the forming rollers or forming cylinders is clearly reduced. The achievable hardness is around five times higher than the hardness of traditional titanium nitride layers. A friction value of clearly under 0.1 is achieved.

Additional advantageous developments of the invention are covered in the subordinate claims.

The invention will be explained in more detail with the aid of the exemplary embodiments represented schematically in FIGS. 1 to 3.

BRIEF DESCRIPTION OF THE DRAWINGS

The advantages, nature and various additional features of the invention will appear more fully upon consideration of the illustrative embodiment of the invention which is schematically set forth in the drawing, in which.

Figure 1:
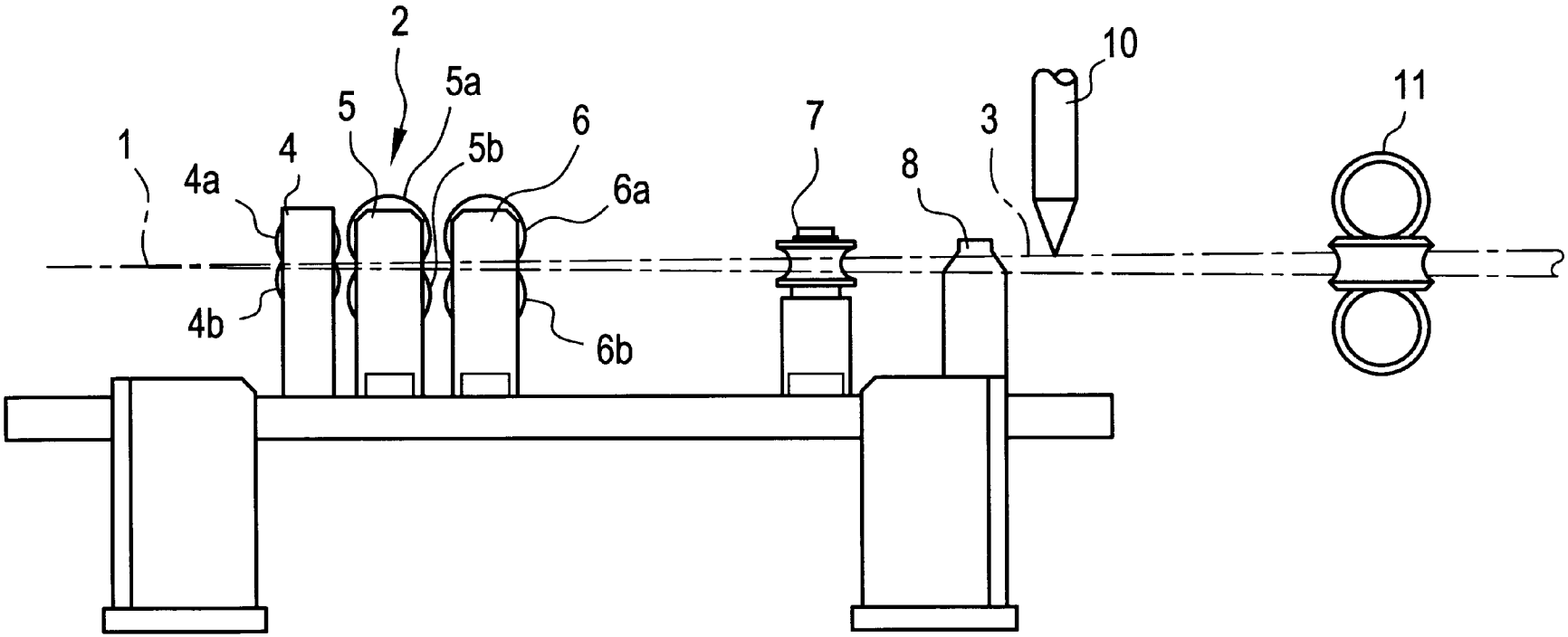
FIG. 1 is a diagrammatical representation of an embodiment of the present invention.

The metal band 1 drawn off from a run-off block not represented, for example, an aluminum band with a wail thickness of 0.25 mm and a band width of ca. 20 mm is formed in a forming device 2 in several forming stages into a slotted pipe 3 and immediately behind the last forming stage processed into a longitudinally welded pipe by means of arc-welding or by means of lasers.

DETAILED DESCRIPTION OF THE INVENTION

The first three forming stages 4, 5, and 6 each consist of an upper forming roller 4, 5*a*, and 6*a* as well as a lower forming roller 4*b*, 5*b*, and 6*b* between which the aluminum band 1 is gradually transformed into the form of a pipe. A vertically mounted pair of forming rollers 7 and a forming ring 8 closed in it complete the forming device 2. Behind a welding device 10 the pipe 3 is conveyed to a turk's head 11 which reduces the outer diameter of the pipe 3.

In this device the highest pressures occur in the first forming stage 4 since there the radius of curvature of finished slotted pipe 3 is imparted to the edges of the bands. For this purpose it is necessary to choose a smaller radius of curvature since the elastic portion of the deformation is lost after the first forming stage 4. With the high pressures required cold spots result, and in fact much more at those points of the lower forming roller 4*b* at which the edges of the bands strike the forming roller 4*b*. At those points aluminum accumulates.

Similarly high pressures occur at the rollers of the turk's head. In addition there is the fact that in the case of a turk's head different speeds, seen over the circumference, occur, which leads to an increase in the friction, in particular where the reduction is performed without lubrication of the pipe running through.

The forming rollers 4*a*, 4*b*, 5*a*, 5*b*, 6*a*, and 6*b* expediently consist of steel. The rollers 4*a*, 5*a*, 5*b*, 6*a*, and 6*b* can however consist of plastic, for example, polyethylene, polyamid, and so on. The roller 4*b* must in any case consist of steel since it is stressed the most.

According to the teaching of the invention the forming rollers 4*a*, 4*b*, 6*a*, 6*b*, 6*a*, and 6*b* have, when they consist of steel, a surface hardness of more than 100 GPa. This extremely high hardness has been achieved by the deposition of carbon atoms in the crystal lattice of the steel of the forming roller. The process developed for this purpose has been published in the journal "MO Metalloberfläche" [MS Metal Surface], Carl Hanser Verlag 50, Volume 4/96.

Figure 2:
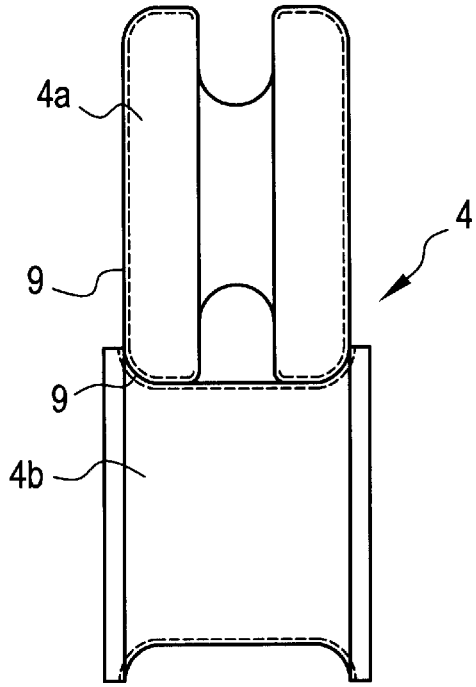
FIG. 2 is a diagrammatical representation of a first forming stage of the present invention.

FIG. 2 shows a view of the first forming stage 4 with the forming rollers 4*a* and 4*b* between which the edge areas of the metal band not described in more detail are deformed extremely strongly. The hardened surface of the forming roller 4*a* and 4*b* is represented as a dotted line and designated as 9.

Figure 3:
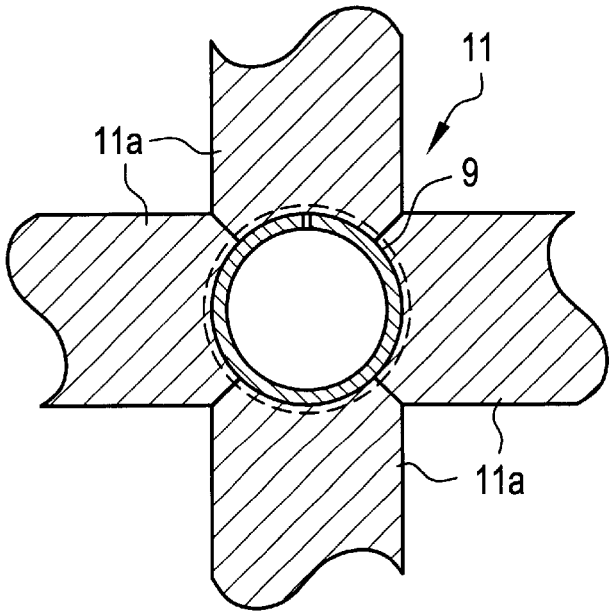
FIG. 3 is a diagrammatical representation of a component of the apparatus disclosed in FIG. 1.

FIG. 3 shows a section through a turk's head which consists of the four rollers 11. The surface of the rollers also has a hardness of more than 100 GPa.

What is claimed is:

1. Process for the production of metal pipes in which a thin-walled metal band inclined toward cold spots is gradually formed into a slotted pipe, the longitudinal edges lying flush against one another are welded to one another, and the welded pipe is reduced in its diameter, where the forming of the metal band into the slotted pipe is done by opposing metal forming rollers or forming cylinders cooperating pairwise and the forming rollers or forming cylinders guide the metal band to be deformed in its edge area with rolling friction between them characterized by the fact that the forming and guiding of the metal band is done with forming rollers and/or forming cylinders and the reduction is done with reducing rollers, wherein carbon atoms are integrated into a surface of at least one of the forming rollers and/or forming cylinders and the reducing rollers such that said at least one of the forming rollers and/or forming cylinders and the reducing rollers has a hardness higher than 100 GPa and a friction value of under 0.1.

2. Process according to claim 1 wherein said at least one of said forming rollers and/or forming cylinders and the reducing rollers contain steel and said carbon atoms are deposited into a crystal lattice of said steel.

* * * * *